United States Patent [19]

Evans

[11] Patent Number: 5,014,820

[45] Date of Patent: May 14, 1991

[54] ENGINE PRELUBRICATOR AND PRESSURIZED LUBRICANT RESERVOIR

[76] Inventor: John W. Evans, Rte. 41, Sharon, Conn. 06069

[21] Appl. No.: 498,459

[22] Filed: Mar. 21, 1990

Related U.S. Application Data

[63] Continuation of Ser. No. 296,331, Jan. 10, 1989, abandoned, which is a continuation of Ser. No. 817,784, Jan. 8, 1986, abandoned, which is a continuation of Ser. No. 557,397, Dec. 2, 1983, abandoned, which is a continuation-in-part of Ser. No. 331,371, Dec. 16, 1981, abandoned.

[51] Int. Cl.[5] ..... F01M 1/00

[52] U.S. Cl. ..... 184/6.3; 123/196 R; 123/196 M; 123/196 S

[58] Field of Search ..... 184/6.6, 364, 6.21, 184/6.23, 6.24, 1.5-1.57, 105 R, 196 R, 7, 198 DR, 6; 137/559; 251/493, 76, 300.3, 120, 129, 333; 220/22, 322, 335, 349; 340/626; 187/51, 78, 561 A; 123/196 R, 196 A, 196 M, 196 S, 198 DA

[56] References Cited

U.S. PATENT DOCUMENTS

| | | | |
|---|---|---|---|
| 1,359,988 | 11/1920 | Hansen | 137/599 |
| 1,697,865 | 1/1929 | Hahn | 137/599 |
| 1,786,269 | 12/1930 | Solomon | 123/196 M |
| 1,920,012 | 7/1933 | Good | 184/6.3 X |
| 2,111,430 | 3/1938 | Lamar | 137/599 |
| 2,273,888 | 2/1942 | Paulsen | 123/196 S |
| 2,373,349 | 4/1945 | Serrell | 184/6.24 |
| 2,640,475 | 6/1953 | Chase | 123/196 M |
| 2,736,307 | 2/1956 | Wilcox | 184/6.3 X |
| 2,747,564 | 5/1956 | Wehling | 123/196 S |
| 2,755,787 | 7/1956 | Butler et al. | 184/6.3 X |
| 2,863,628 | 12/1958 | Rimsha et al. | 251/30 |
| 2,889,821 | 6/1959 | Maki | 184/6.3 X |
| 3,050,315 | 8/1962 | Kindler et al. | 220/22 X |
| 3,138,221 | 6/1964 | Kofink et al. | 184/6.3 |
| 3,262,466 | 7/1966 | Adams et al. | 137/561 A X |
| 3,394,731 | 7/1968 | Elliott | 137/527.8 |
| 3,422,807 | 1/1969 | Waldecker | 184/6.3 |
| 3,556,070 | 12/1971 | Holcomb | 184/6.3 |
| 3,583,525 | 6/1971 | Holcomb | 123/196 S X |
| 3,610,457 | 10/1971 | Opalewski | 220/22 |
| 3,630,482 | 12/1971 | Beller | 251/30 |
| 3,722,623 | 3/1973 | Waldecker | 184/6.3 |
| 3,979,005 | 9/1976 | Robinson et al. | 220/22 X |
| 4,061,204 | 12/1977 | Kautz | 184/6.3 |
| 4,094,293 | 6/1978 | Evans | 184/6.3 X |
| 4,151,823 | 5/1979 | Grosse et al. | 123/196 A |
| 4,157,744 | 6/1979 | Capriotti | 184/6.3 |
| 4,359,140 | 11/1982 | Shreve | 184/6.3 |
| 4,363,214 | 12/1982 | Kiser | 184/6.3 X |
| 4,389,984 | 6/1983 | Destrampe | 123/196 S |

FOREIGN PATENT DOCUMENTS

| | | | |
|---|---|---|---|
| 527138 | 3/1954 | Belgium | 137/599 |
| 591082 | 4/1959 | Italy | 137/561 A |
| 286088 | 3/1928 | United Kingdom | 184/6.3 |

*Primary Examiner*—Leonard E. Smith
*Attorney, Agent, or Firm*—Kenyon & Kenyon

[57] ABSTRACT

An improved prelubricator and pressurized lubricating fluid reservoir assembly for use primarily with an internal combustion engine, comprising a hollow cylindrical container coupled to the engine lubricating system and mounted at an angle between about 20° and 90° with respect to the horizontal. The container may be coupled to the engine by a valve assembly which permits the unrestricted flow of lubricating fluid out of the reservoir during start up of the engine or during periods of low oil pressure, and into the reservoir during periods of normal engine operation. Also disclosed is an assembly which is particularly advantageous for lubricating the center bearing of an exhaust-driven turbocharger.

4 Claims, 5 Drawing Sheets

55
16
55
20°
28
59
29
28
27
27'
26
25
61
12
10
16
63
22
21
19
18
20
23
17
24
14
60
TO CENTER BEARING

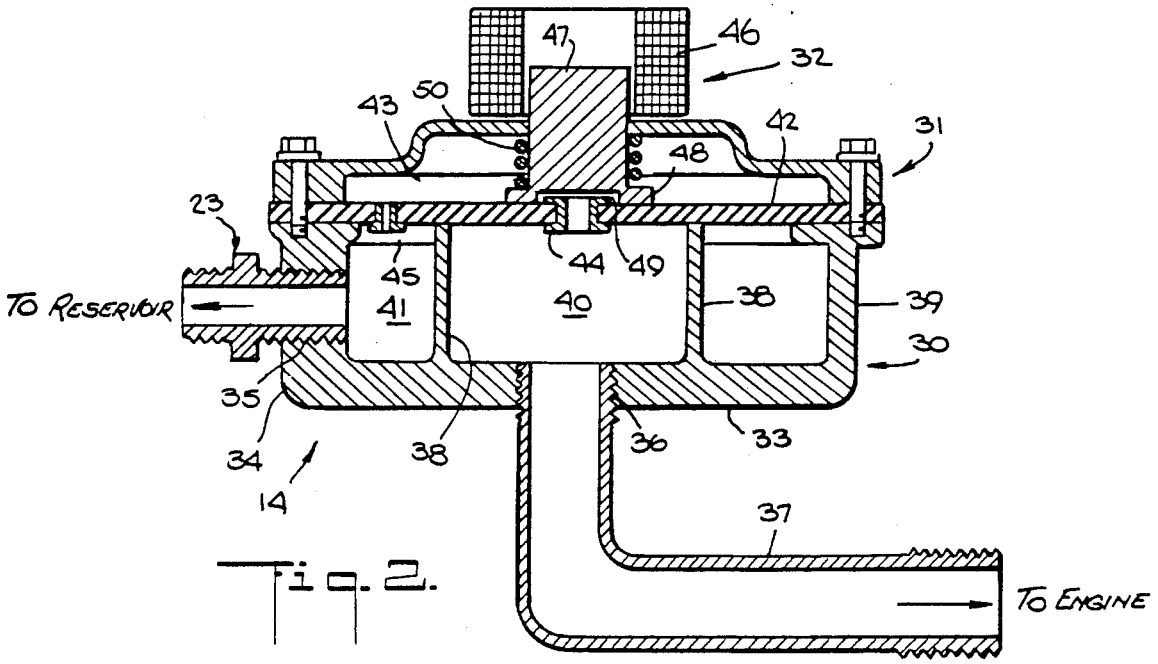
Fig. 2.
Fig. 3.
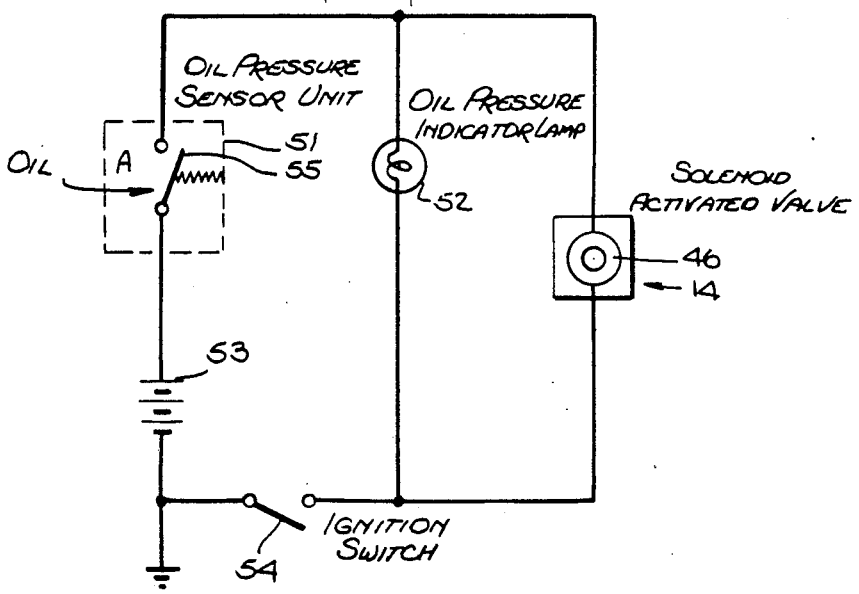

ENGINE PRELUBRICATOR AND PRESSURIZED LUBRICANT RESERVOIR

This application is a continuation of application Ser. No. 07/296,331 filed Jan. 10, 1989, now abandoned, which is a continuation of application Ser. No. 06/817,784 filed Jan. 8, 1996, now abandoned, which is a continuation of application Ser. No. 06/557,397 filed Dec. 2, 1983, now abandoned, which is a continuation in part of application Ser. No. 06/331,371 filed Dec. 16, 1981, now abandoned.

BACKGROUND OF THE INVENTION

1. Field of the Invention

The invention is directed generally to an improved prelubricator and pressurized lubricant reservoir assembly for use with machinery requiring lubrication, such as an internal combustion engine.

2. Description of the Prior Art

The use of preoiling devices and oil reservoirs or accumulators of various designs in conjunction with internal combustion engines is generally well known. It has long been an acknowledged fact that a great deal of engine wear occurs as a result of "cold start scuffing", i.e., the starting of an engine after it has been idle for a period of time sufficient to allow its lubricating oil to drain into the engine's oil pan and crankcase, thus leaving many vital engine parts with no lubricant protection until the engine has been started and the oil pressure brought up to an acceptable level by the oil pump. Various preoiling devices have been designed, all having the purpose of providing oil pressure to the engine prior to start up. However, a number of these preoilers have been bulky and complex, cumbersome, have often required separate pumps, have utilized complex valving arrangements, have been difficult to service, and have generally been unacceptable for use in commercial passenger vehicles. Examples of such devices are disclosed in U.S. Pat. Nos. 3,422,807 and 3,722,623 to Waldecker, and 3,556,070 and 3,583,525 to Holcomb.

My prior U.S. Pat. No. 4,094,293 issued June 13, 1978 discloses an engine preoiler and lubricant reservoir assembly comprising a hollow cylinder divided into two chambers by a slidable piston which overcomes the aforementioned disadvantages of the prior art. Although this preoiler and reservoir assembly is a significant improvement over previous devices, the use of a slidable piston between the oil and the air in the reservoir cylinder has certain disadvantages. For example, during cold weather, the force required to break the seal between the piston rings and the interior cylinder wall increases significantly. Thus, when ambient air temperature decreases, a condition when preoiling of an engine is important, the effectiveness of the preoiler is decreased and its lubricant discharge rate is slowed. Also, the assembly uses a number of moving parts, which periodically wear out and must be replaced, and regular maintenance of the assembly is required. Such a piston-type reservoir is also expensive and complex to manufacture, and is of considerable weight, which affects fuel economy.

SUMMARY OF THE INVENTION

It is accordingly an object of the invention to provide an engine prelubricator and pressurized lubricant reservoir assembly which has improved effectiveness during cold weather operation; has increased longevity and reduced maintenance requirements; which is less expensive and less complex to manufacture; and which is lighter in weight than heretofore known preoilers and lubricant reservoirs.

It is a further object of the present invention to provide a pressurized lubricant assembly for lubricating the center bearing of an exhaust driven turbocharger during the time period immediately after engine shut down.

It is still another object of the present invention to provide a pressurized lubricant assembly for lubricating the center bearing of an exhaust driven turbocharger during engine start up.

It is yet another object of the present invention to provide pressure relief means for an engine prelubricator and pressurized lubricant reservoir assembly.

These and other objects of the invention are achieved in an improved engine prelubricator and lubricant reservoir assembly for lubricating machinery, such as an internal combustion engine, when the lubricant pressure in the machinery is below a specified level. The assembly comprises a hollow container for storing a quantity of lubricant, one end of which is coupled to the machinery so as to permit the flow of lubricant between the machinery and the container. The container is axially disposed at an angle of between about 20° and 90° with respect to the horizontal and so that the end of the container coupled to the machinery is disposed vertically below the other end of the container. Valve means may be coupled to the machinery and to the one end of the container for controlling the flow of lubricant between the machinery and the container, and may be further adapted to permit the unrestricted flow of lubricant to the container from the machinery for filling the container and compressing air contained therein when the lubricant pressure is at or above the specified level, and to permit unrestricted flow of the lubricant from the container to the machinery when the lubricant pressure is below the specified level.

The foregoing improved assembly has all the advantages of my previous design described in my aforementioned prior U.S. patent. In addition, because a piston or other divider (e.g., a diaphragm) is not used between the lubricant and the air in the container, but instead is eliminated by the angular directional mounting of the reservoir (which causes the formation of an air bubble within the container over the lubricant, e.g., oil which is compressed as the lubricant is admitted), discharge rate R reduction of the assembly caused by operation during cold weather is prevented since the air bubble in the container is effectively friction-free. Also, there are no moving parts to wear out, and the only required maintenance is the application of air pressure to the container when changing the engine lubricant in order to purge the container and its connecting lines of residual lubricant after it is drained. Moreover, by using so-called "deep drawn" aluminum fabrication techniques, the entire container can be manufactured in two stamping operations, thereby significantly reducing manufacturing costs. (Experience has shown that fabrication costs can be reduced to less than 1/12 of that of my prior assembly.) Finally, the extremely simple design of my improved assembly, when used in combination with aluminum fabrication techniques, results in weight reduction with resulting beneficial effects on fuel economy. (Experience has shown that a reservoir can be designed which is only one pound heavier than the weight of the lubricant stored in the reservoir.)

Another aspect of the present invention is directed to a pressurized lubricant system for the center bearing of an exhaust driven turbocharger for providing pressurized lubricant to the center bearing during turbocharger spin-down immediately after engine shut down when the engine lubricant system will no longer be providing pressurized lubricant. A preferred T-type valve and conduit arrangement for use with a pressurized lubricant system for the center bearing of an exhaust driven turbocharger is also disclosed herein.

A further aspect of the present invention is directed to the provision of pressure relief means for an engine prelubricator and pressurized lubricant reservoir assembly.

Still another aspect of the present invention is directed to a pressurized lubricant system for the center bearing of an exhaust driven turbocharger having solenoid controlled valve means with pressure relief means whereby pressurized lubricant is provided to the center bearing of an exhaust driven turbocharger during the time period immediately after engine shut down and during engine start up.

These and other novel features and advantages of the invention are described in greater detail in the following detailed description.

BRIEF DESCRIPTION OF THE DRAWINGS

FIG. 2 is a cross-sectional side view of a valve for use in conjunction with the assembly of FIG. 1;

FIG. 3 is a schematic diagram of one embodiment of a valve actuating means for use in conjunction with the valve illustrated in FIG. 2;

DETAILED DESCRIPTION

Figures 1, 5:
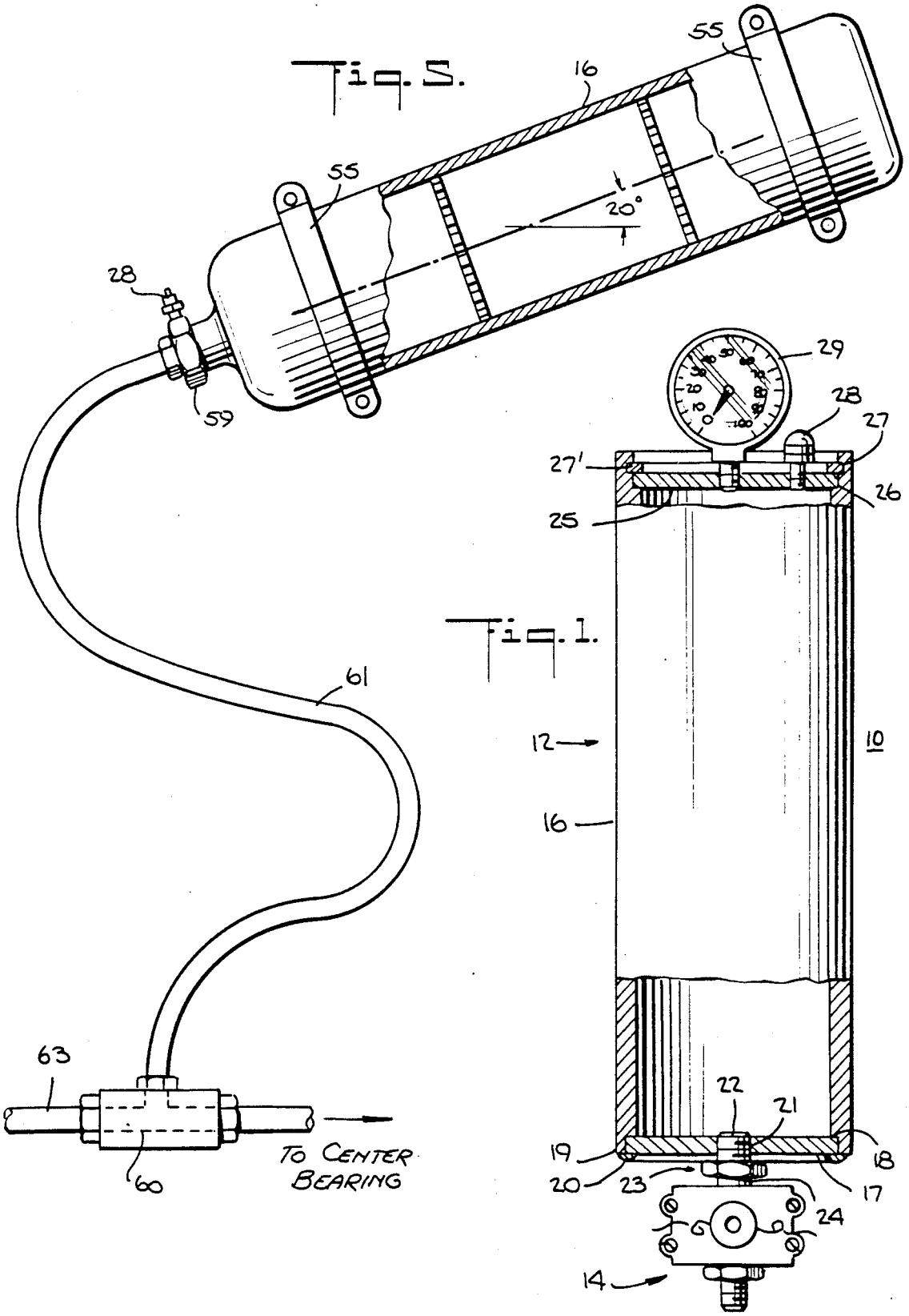
FIG. 1 is a top plan view, partly in section, of one embodiment of an improved engine prelubricator and pressurized lubricant reservoir assembly constructed in accordance with the invention.
FIG. 5 is a schematic illustration of another embodiment of an improved engine prelubricator and pressurized lubricant reservoir assembly constructed in accordance with the present invention which is particularly advantageous for use in lubricating the center bearing of an exhaust-driven turbocharger.

Referring now to FIG. 1, there is shown one embodiment of an engine prelubricator and pressurized lubricant reservoir assembly constructed in accordance with the present invention. Assembly 10 includes a lubricant reservoir illustrated as oil reservoir 12 and a valve assembly 14, which in the illustrated embodiment of the invention is a solenoid-actuated valve assembly seen in cross-section in FIG. 2. It should be noted that the valve assembly 14 may comprise a manually-actuated valve assembly instead of the solenoid-actuated assembly illustrated in the drawings.

Oil reservoir 12 as illustrated in FIG. 1, be fabricated as a hollow cylinder 16 which may, for example, be formed of aluminum, have an overall length of 13 inches, with an O.D. of 3 inches, and a capacity of 1 quart. It will, of course, be recognized that the actual dimensions of cylinder 16 may be varied to change the capacity of the reservoir, and that oil reservoir 12 need not be a cylinder but could have various other shapes. As will be described later herein, the cylinder may also be fabricated as an integral structure instead of from separate elements as illustrated in FIG. 1.

Referring to FIG. 1, a first end plate 17 is positioned in a suitable recess 18 at a first end 19 of cylinder 16 and is retained in place by suitable means such as a line of weld 20. Alternatively, plate 17 could be secured in recess 18 by a resilient snap ring or clip. First end plate 17 is disc-shaped and completely closes the first end 19 of cylinder 16. This plate may be fabricated of the same material as the body of cylinder 16 and is provided with a threaded aperture 21 into which a first end 22 of a suitable threaded connector 23 may be screwed. The valve assembly 14 is screwed onto the free end 24 of connector 23. The end plate 17 thus may be either a permanent installation which is not intended to be removed or may be removably secured in the end 19 of cylinder 16.

A second end plate 25 is positioned in a suitable recess 26 in a second end 27 of cylinder 16. Second end plate 25 is also fabricated of the same material as cylinder 16 but is removably secured in place by a resilient snap ring or clip 27'. Alternatively, plate 25 may be permanently secured in cylinder 16 by means of a line of weld, such as weld 20 at end 19 of the cylinder An air valve 28 may be provided in second end plate 25 and allows air under pressure to be admitted to or removed from the interior of cylinder 16. A suitable air pressure gauge 29 may also be mounted on the second end plate 25. Alternatively, a pressure gauge could be applied to valve 28 to read the air pressure in the cylinder. Thus, oil which is admitted through valve assembly 14 into cylinder 16 will flow toward the second or gauge end 27 of cylinder 16 and will compress whatever air may be within the cylinder. By either adding or withdrawing air through valve 28, the pressure exerted on the oil may be varied. Although both air valve 28 and pressure gauge 29 have been illustrated as being mounted in end plate 25, it should be noted that either one may be mounted at any location on cylinder 16.

This assembly also permits the pre-charging of the reservoir 12 before it is placed into a vehicle. To do so, valve assembly 14 is removed and one quart of oil is placed in cylinder 16. Valve assembly 14 is then replaced and the cylinder pressurized by forcing air under pressure through valve 28 into cylinder 16. Alternatively, end plate 25, if removably secured in cylinder 16 as illustrated in FIG. 1, may be removed by removing retaining ring 27'. Oil is then added, the end plate 25 and ring 27' replaced, and cylinder 16 charged with air through valve 28.

It can be readily seen that reservoir 12 is an uncomplicated assembly capable of storing a desired quantity of oil at a specified pressure, and of discharging the oil when valve assembly 14 is opened. There are no moving parts in the reservoir and it is virtually maintenance free. The size of the reservoir is such that it can be placed either in the vehicle's engine compartment or at a remote location such as affixed to a frame member, and takes up little space. A further advantage of an elongated hollow cylinder reservoir having a substantially constant internal diameter along its length is that it presents a constant air to oil surface area regardless of the state of charge or discharge and thus resembles in operation a piston type reservoir without the disadvantages of a piston type reservoir hereinbefore discussed.

Valve assembly 14 controls the flow of oil or other lubricating fluid either into or out of reservoir 12. Referring now to FIG. 2, assembly 14 is comprised generally of a valve body portion 30, a valve cover portion 31 and a solenoid actuator 32. Valve body 30 includes a bottom portion 33 and upstanding walls 34, one of which is provided with a threaded aperture 35 into which connector 23 is screwed so that the valve body is in fluid communication with reservoir 12. The bottom 33 of valve body 30 is provided with a threaded aperture 36 into which a suitable conduit 37 is screwed which is in communication with the engine. At least one interior partition 38 extends upwardly within the valve body to the same height as walls 39 of valve body 30 and divides the valve body into two chambers, a first or inner chamber 40 which is in communication with the engine through aperture 36, and a second or outer surrounding annular chamber 41 which is in communication with reservoir 12 through connection 23. There are preferably four partitions which form a rectangular chamber around threaded aperture 36. However, it is necessary only that the valve body be divided into two chambers with aperture 35 in one and aperture 36 in the other.

As may be seen in FIG. 2, a resilient diaphragm 42 is positioned between valve body 30 and cover 31. This diaphragm is generally planar in its unflexed state and abuts the upper ends of interior partition 38, thus further defining first or inner chamber 40 and second or outer chamber 41 in valve body 30 and defining a third chamber 43 above diaphragm 42 and below cover 31. A first aperture 44 passes through diaphragm 42 and below cover 31. A first aperture 44 passes through diaphragm 42 at a portion of the diaphragm within the perimeter of first chamber 40, and a second aperture 45 passes through the diaphragm at a point within the perimeter of second chamber 41. First aperture 44 is approximately twice as large as second aperture 45.

Solenoid actuator 32 is mounted on valve cover 31 and includes a conventional field coil 46 and a conventional iron armature or plunger 47 which passes through a suitable opening in the cover 31. The lower portion of plunger 47 terminates in an outwardly extending, circumferential lip 48 and an inner recess 49 which surrounds central aperture 44 in diaphragm 42 when the plunger is in its de-energized position. A coil spring 50 surrounds the plunger and urges the plunger downwardly to insure a firm seat on diaphragm 42 when the coil 46 is deenergized. Further details of the construction and operation of valve assembly 14 are described in my prior U.S. Pat. No. 4,094,293, which disclosure is specifically incorporated by reference herein.

Referring now to FIG. 3, a conventional oil pressure sensor unit 51, shown in dashed lines, may be wired in parallel with a conventional oil pressure indicator lamp 52 and with the coil 46 of solenoid actuated valve assembly 14. A conventional battery 53 and ignition switch 54 are also included in the circuit. The oil pressure sensor unit 51 is of the type having a switch 55 which is biased by suitable spring means to a closed position to actuate the indicator light 52 until the engine's oil flow, indicated by arrow A, has sufficient pressure to open the switch 55, thereby switching off the indicator light. By placing valve assembly 14 in parallel with the oil pressure sensor and indicator lamp, the valve will be energized whenever the ignition switch is closed and the engine's oil pressure is below the level required to put out the indicator light.

Figures 4, 4A:
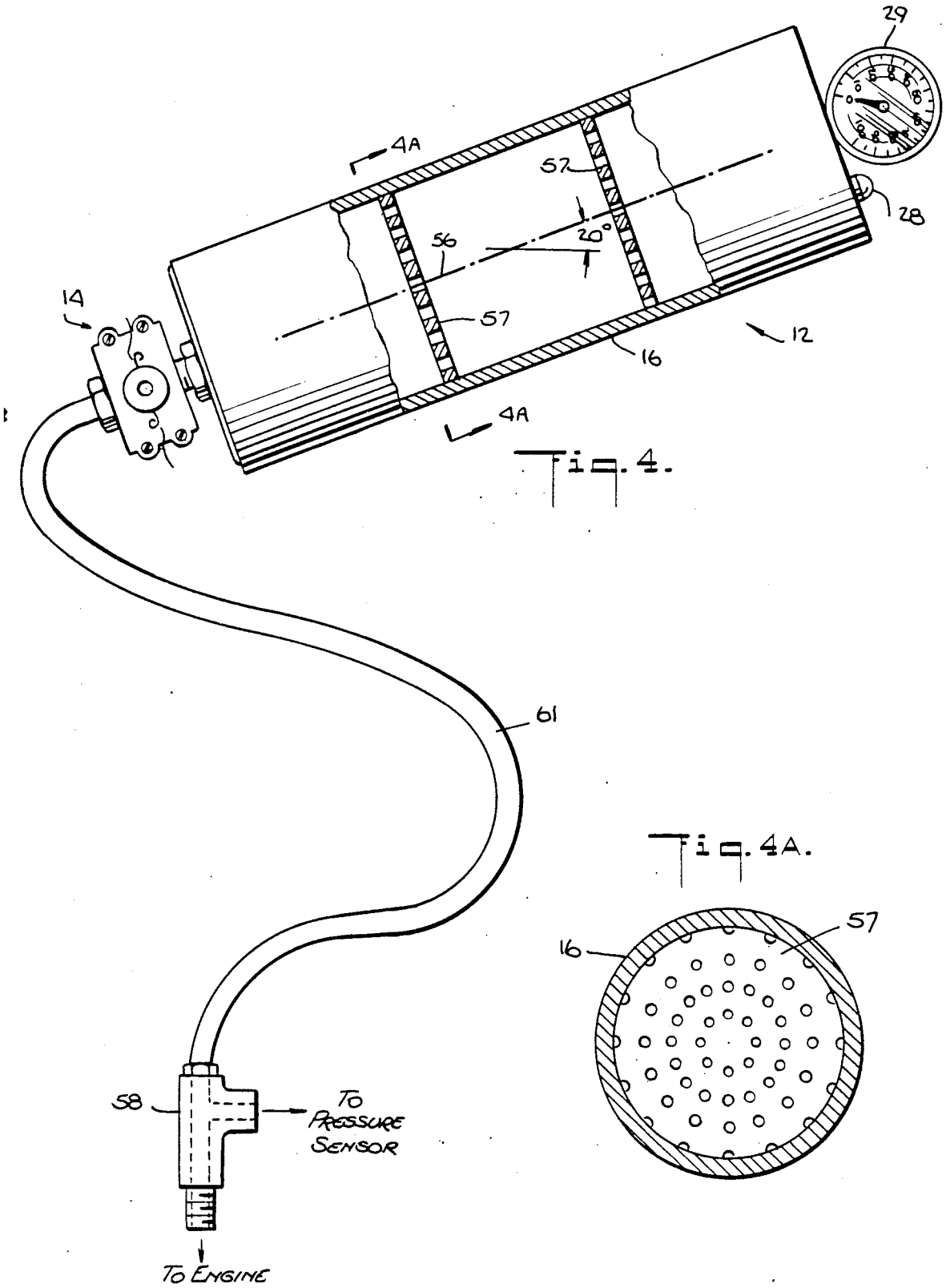
FIG. 4 is a perspective view, partly in section, illustrating the angular mounting of the assembly of FIG. 1.
FIG. 4*a* is a cross-sectional view of the assembly taken along line 4*a*–4*a* of FIG. 4.

Referring now to FIGS. 4 and 4*a*, cylinder 16 is mounted using, for example, mounting brackets 55,; so that the longitudinal axis 56 of the container is disposed at an angle of at least about 20° with respect to the horizontal, specifically between about 20° and 90° with respect to the horizontal, and so that the end of the container to which valve assembly 14 is coupled is disposed vertically below the end of the container to which air valve 28 is coupled. When the container is mounted at such an angle, an air pocket will form above the oil flowing into the reservoir. The oil will compress the air and hold the pressurized air in the container until valve assembly 14 permits the oil to flow from the reservoir to the engine.

Baffles 57 may be disposed within cylinder 16 to control movement of the lubricant, for example, oil surge during cornering and braking of the vehicle, to eliminate foaming of the oil, and to provide for an even discharge of lubricant. Although the baffles have been illustrated as comprising perforated disks, it should be noted that wire mesh, expanding plastic foam such as that used in fuel storage tanks, among other designs and materials, may also be utilized. Valve assembly 14 is coupled by means of a hose 61 and an adaptor 58 to the engine and to pressure sensor 51.

In operation of the embodiment of the invention shown in FIGS. 1–4, reservoir 12 is preferably first filled with approximately one quart of oil, valve assembly 14 is secured, and reservoir 12 is pressurized to approximately 50 P.S.I.G. or the working hot oil pressure. As may be seen in FIG. 2, no oil can leave the reservoir 12 because diaphragm 42 is forced into its closed position by the action of plunger 47 and coil spring 50 pushing the diaphragm downwardly against partitions 38 sealing off the interior of chamber 40. As the ignition switch is closed, the oil pressure sensor switch 55, which is closed by the spring as there is no oil pressure in the engine, allows current to flow to the indicator light 52 and concurrently to the solenoid 46 of the valve assembly 14. Plunger 47 is pulled up, lifting the lip 48 off diaphragm 42. At the same time, the one quart of oil in reservoir 12 starts to flow through connector 23 into chamber 41 and forces diaphragm 42 up off its sealing engagement with partitions 38 so that the oil enters chamber 40 and flows to the engine through conduit 37, nose 61, and adapter 58. The initiation of oil flow is virtually simultaneous with the closing of the ignition switch and the engine is supplied with oil even before the starter is engaged.

The starter is then engaged and the engine starts to run. During this time, the quantity of oil remaining in cylinder 16 decreases and the pressure in the container exerted by the compressed air on the remaining oil also decreases. During this same period of time, the engine's oil pressure, generated by the oil pump, is increasing but is still not sufficient to open the oil pressure sensor switch 55 and the solenoid 46 remains energized. As the engine oil pressure becomes greater than the pressure remaining in cylinder 16, oil will start to flow from the engine through conduit 37 into the valve assembly 14. However, during this time while the engine is building up oil pressure but the oil pressure sensor switch has not been closed, the oil flow should preferably go to the engine and not to recharging reservoir 12. Valve assembly 14 now acts generally as a variable rate check valve and prevents a high volume flow into cylinder 16 by limiting the flow of oil from the engine through the valve to the cylinder while the engine's oil pressure is increasing but before it has reached a pressure sufficient to open pressure sensor switch 55 and de-energize solenoid 46. In this way the reservoir is not replenished rapidly and does not draw oil away from the engine.

As the engine's oil pressure reaches a level sufficient to open the sensor unit's switch 55, shut off indicator lamp 52 and de-energize coil 46, the valve assembly 14 allows the cylinder to rapidly recharge. With coil 46 de-energized, coil spring 50 forces plunger 47 downwardly against diaphragm 42 sealing aperture 44 Since the oil pressure entering the valve unit from the engine is increasing, the diaphragm 42 is now forced upwardly off partitions 38 allowing oil to flow from chamber 40 into chamber 41 and into cylinder 16 toward the gauge end 27 compressing the air and storing three quarts of oil under pressure. When the pressure in cylinder 16 becomes equal to the pressure in the engine, oil will flow from the cylinder 16 into the peripheral chamber 43 above diaphragm 42. Since chamber 43 is now sealed by the de-energized plunger 47, the oil pressure in this upper chamber will combine with the force of coil spring 50 to force diaphragm 42 into its closed position Since the engine's oil pressure is at a maximum when the engine is warming up, the reservoir will be recharged to a high pressure level. As the engine oil pressure decreases to its normal operating level, diaphragm 42 remains closed, holding the oil stored in the cylinder. For a more detailed description of the operation of the valve assembly 14, reference may be had to the specification of my aforesaid U.S. Pat. No. 4,094,293. It should be noted that as stated previously herein, a manual valve, such as a ball valve, may be used instead of valve assembly 14 to control the flow of lubricant to and from cylinder 16 in the same manner by opening and closing the valve to limit the refill and discharge rate of the cylinder.

Figure 6:
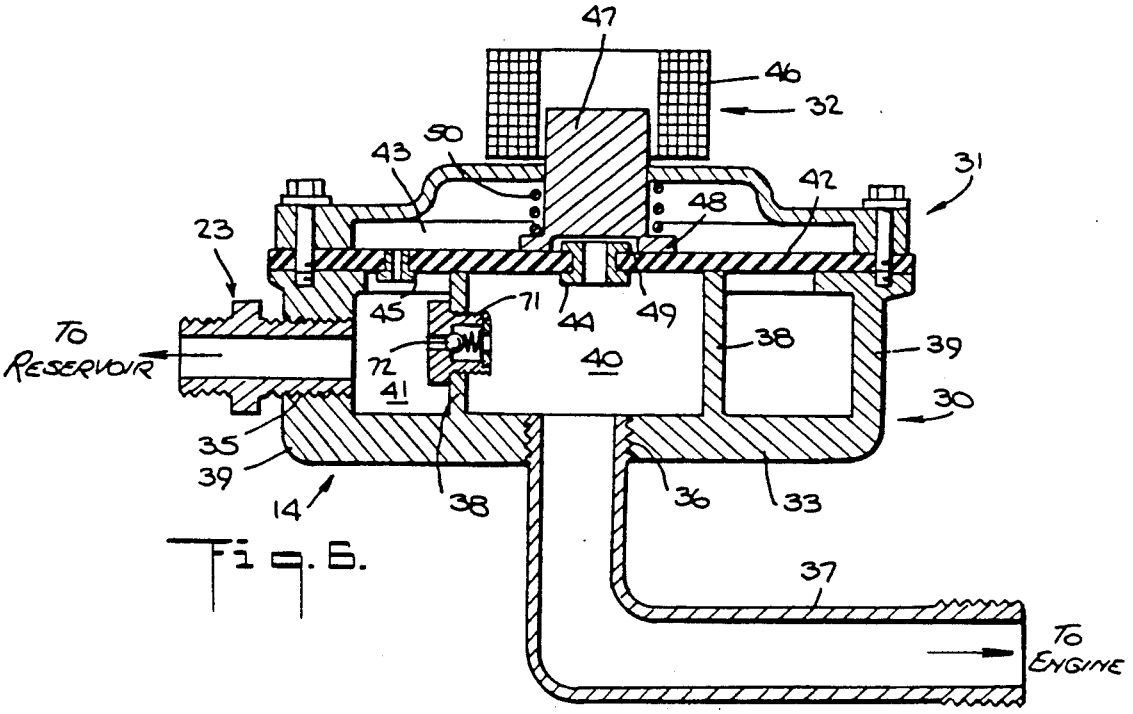
FIG. 6 is a cross-sectional view of a valve similar to that illustrated in FIG. 2 provided with pressure relief means in accordance with another embodiment of the present invention.

In the embodiment of the valve assembly 14 illustrated in FIG. 6, there is illustrated a spring-loaded ball relief valve 71 installed in partition 38 of valve assembly 14. Relief valve 71 may be installed, e.g., by providing a threaded bore in partition 38 and screwing relief valve 71 into this bore. The purpose of relief valve 71 is to prevent over-pressurization of the reservoir 12.

It will be appreciated that the compressed air within the reservoir 12 will have its pressure increased as the amount of oil in reservoir 12 increases. The compressed air pressure could rupture the cylinder 16 if its pressure became too great. The function of relief valve 71 is to prevent failure of cylinder 16 if an excessive pressure surge is encountered during de-energized periods of normally closed valve assembly 14. Possibilities of over-pressures would exist, e.g., if the reservoir assembly 12 is mounted in close proximity to a high heat source such as the exhaust system. Such a situation can result in abnormally high pressures in the reservoir when the valve assembly 14 is closed.

Tests have shown that in the preoiler reservoir system, if 1½ quarts of oil are stored in a two quart capacity reservoir under 80 p.s.i.g. pressure and subjected to 300° F., this will generate an internal resultant pressure of about 1200+p.s.i.g. This is well beyond the safe range of most cost and weight effective reservoir containers.

An excessive over-pressure condition may also occur at a lower temperature of 212+° F. if there is a high level of water present in the lubrication oil. This situation may result because, as oil ages in the crankcase during operation, its water content gradually increases. Once there is a sufficient amount of water in the oil and the temperature rises sufficiently above 212° F. (taking into account the pressure on the system), the water will flash to steam causing the pressure in the reservoir to rise above a safe level.

In operation, safety relief valve 71 is installed in partition 38 separating chambers 40 and 41 of valve assembly 14. Relief valve 71 is set to operate at a pressure level above all normal operating pressures of the lubricant system but well below the failure pressure of cylinder 16. For example, if the lubricant system would be expected to have a maximum high pressure of about 70 to 100 p.s.i.g., safety relief valve 71 could be set to operate at about 400 to 500 p.s.i.g. If the pressure in the reservoir 12 exceeds the set relief pressure, the oil pressure in chamber 41 of valve assembly 14 would be substantially the same. The pressure in chamber 41 would force spring-loaded ball 72 off its seat whereby the excessive oil pressure would be relieved to the engine via chamber 40 and conduit 37. Once the excessive pressure in the reservoir 12 and chamber 41 fall below the pre-set pressure of the relief valve 71, the relief valve 71 closes and the reservoir 12 retains the remainder of the oil charge.

Figure 7:
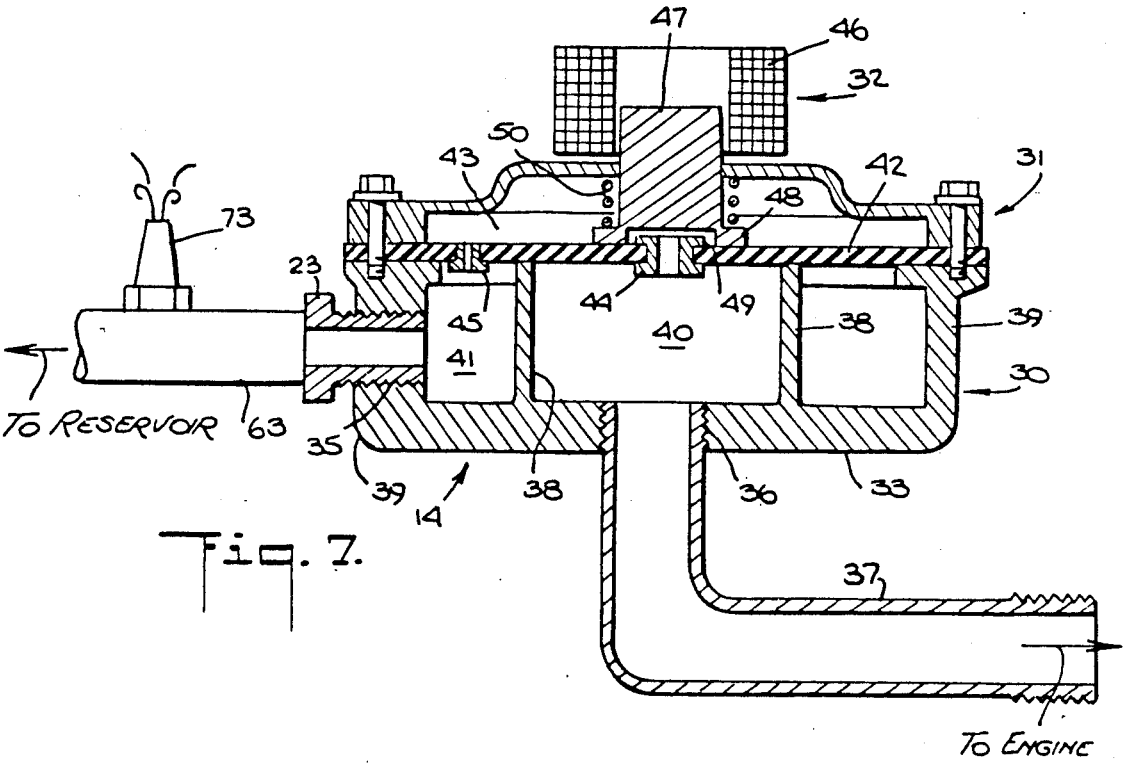
FIG. 7 is a cross-sectional view of another valve similar to that illustrated in FIG. 2 provided with an alternate embodiment of a reservoir pressure relief means in accordance with the present invention.

An alternative safety relief system is illustrated in the embodiment of valve assembly 14 shown in FIG. 7. In the embodiment of FIG. 7, a conventional pressure sensor device 73 is installed in a length of tubing 63 which is connected between connection 23 of valve assembly 14 and the reservoir 12 so as to provide fluid communication between reservoir 12 and valve assembly 14. Accordingly, pressure sensor device 73 will sense the pressure of lubricant stored in reservoir 12. Pressure sensor device 73 will be electrically connected to a conventional battery and the solenoid 46 for activating the solenoid 46 and thereby lifting plunger 47 off diaphragm 42 when pressure sensor device 73 encounters an over pressure condition. Pressure sensor device 73 may be set to operate at, e.g., 400 p.s.i.g. to 500 p.s.i.g.

Figure 8:
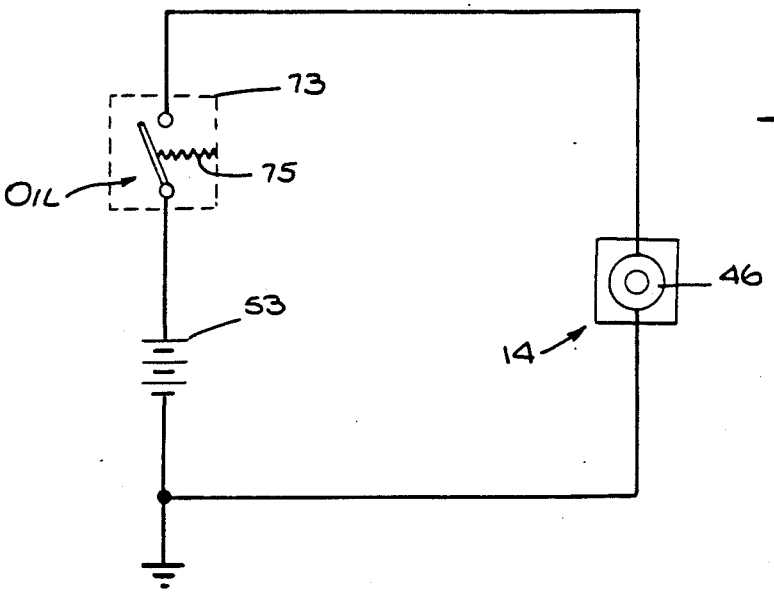
FIG. 8 is a schematic diagram of one embodiment of a valve actuating means for use with a reservoir pressure relief system in conjunction with the valve illustrated in FIG. 7.

FIG. 8 is a schematic diagram illustrating the operation of pressure sensor device 73. With reference to FIG. 8, pressure sensor device 73 is shown in dashed lines and is wired to battery 53 and solenoid 46. Pressure sensor device 73 may be a spring operated switch which is held open by compression spring 75 when oil pressure is in the normal operating range. When over pressure of the oil occurs, oil pressure will close pressure sensor device 73 against the force of spring 75 and complete the electrical circuit to solenoid 46. Solenoid 46 is actuated and plunger 47 is lifted off diaphragm 42. It will be appreciated that in a static condition, the oil pressure in chamber 43 will be equal to the oil pressure in chamber 41 of valve 14 and thus equal to the oil pressure in reservoir 12 by means of fluid communication provided between chambers 41 and 43 by small orifice 45. Upon lifting of plunger 47, large orifice 44 will be opened and the oil pressure chamber 43 will be vented to the engine via orifice 44, chamber 40 and conduit 37. The lifting of plunger 47 off diaphragm 42 and the venting of the oil pressure from chamber 43 will permit the oil pressure in chamber 41 to lift diaphragm 42 off partition walls 38 thereby permitting flow of oil from reservoir 12, through chamber 41, over partition walls 38, into chamber 40 and thence to the engine via conduit 37.

When the oil pressure in reservoir 12 falls below the pressure for which pressure sensing device 73 is set, spring 75 will cause the switch of pressure sensing device 73 to open and de-energize solenoid 46. Plunger 47 will be pressed against diaphragm 42 closing large orifice 44. Oil pressure will begin to build in chamber 43 above diaphragm 42 via small orifice 45 and the force of plunger 47 (caused by spring 50) and the oil pressure in chamber 43 will force diaphragm 42 against partition walls 38. This will again shut off fluid communication between reservoir 12 and the engine.

It will be understood that the prelubricator and pressurized reservoir assembly of the present invention and valve assembly 14 will operate satisfactorily in many instances without the use of a reservoir pressure relief system.

Figure 9:
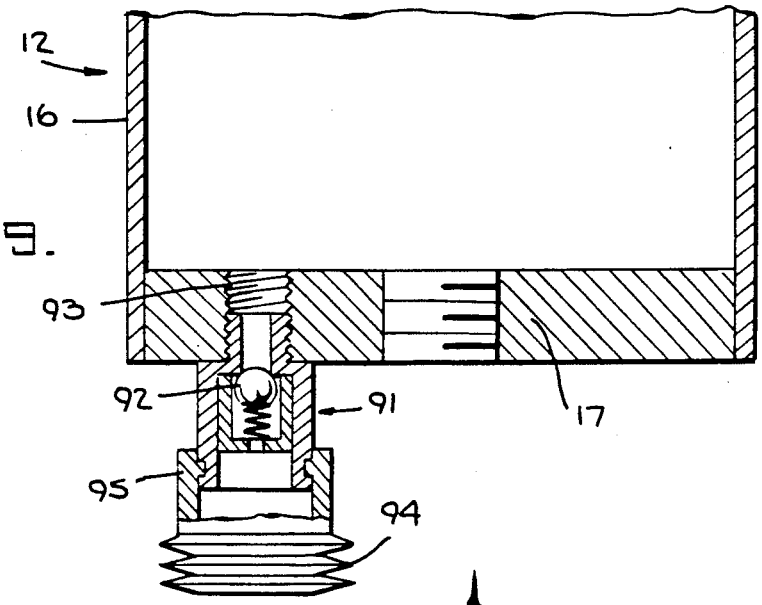
FIG. 9 is a fragmentary cross-sectional view of the fluid outlet end of the pressurized lubricant reservoir illustrated in FIG. 1 having an external pressure relief means in accordance with the present invention.

Another pressure relief means which may be advantageously employed in accordance with the present invention is illustrated in FIG. 9. In this embodiment, a spring-loaded ball relief valve 91 is installed in first end plate 17 of reservoir container 16 (i.e., the oil side of the reservoir). Relief valve 91 may be installed, e.g., by providing a threaded bore 93 in first end plate 17 and screwing relief valve 91 into this bore. The purpose of relief valve 91 is to prevent overpressurization of reservoir 12. Excess pressure will force spring-loaded ball 92 off its seat and discharge lubricant from the reservoir to the exterior. The same considerations may be used for setting spring loaded relief valve 91 as for the setting of spring loaded relief valve 71 of valve means 14 (FIG. 6).

An expandable bellows 94 may be connected to relief valve 91, e.g., by collar 95, in order to catch and store any lubricant relieved from the reservoir. Other suitable container means may be connected to the relief valve 91. However, connection of a container to the means to the relief valve 91 is not required. The purpose of a container means, such as expandable bellows 94, is to serve as a visual indicator that the safety relief has been actuated and thereby provide an alert that a situation is present which is causing excessive pressure and/or hydraulic lock.

The safety relief valve of the embodiment of FIG. 9 may be suitably employed when a conventional manual valve is used with the engine prelubricator and pressurized lubricant reservoir of the present invention instead of the automatically actuated valve assembly 14.

Another embodiment of the improved engine prelubricator and lubricant reservoir assembly of the invention which is particularly useful for lubricating the center bearing of an exhaust driven turbocharger during engine start-up and shutdown is shown in FIG. 5. This embodiment is similar to the reservoir illustrated in FIGS. 1 and 4 except that cylinder 16 is an integral, stamped hollow cylinder and valve assembly 14 is replaced by an open coupling 59 and the adapter 58 is replaced by a one-way check valve 60. The container is mounted in the same manner as described with reference to FIG. 4, and the check valve 60 is installed in the oil line 63 extending between the engine oil pump and the center bearing of the turbocharger.

In operation, pressurized oil passes through check valve 60 to both the turbocharger center bearing and through the hose 61 coupled to check valve 60 to reservoir 12. This fills the reservoir and compresses the air pocket inside. Once the oil pressure in the check valve and hose is equal to the pressure in container 16, the reservoir will remain filled with oil and compressed air until the engine is shut down and the engine oil pressure entering at check valve 60 decreases. The pressure in the reservoir will then, through hose 61, close check valve 60 to prevent back flow of lubricant to the engine oil pump, and thus permit unrestricted flow of the lubricant from the reservoir through the hose 61 and oil line 63 to the center bearing.

This embodiment of the invention is particularly advantageous for lubricating the center bearing of such a turbocharger since the idle speed of a turbocharger exceeds 30,000 rpm (top speed 90,000 to 120,000 rpm), and 20 to 30 seconds can elapse between the time when the engine is shut down and the flow of oil to the turbocharger center bearing ceases, and the time when the turbocharger stops turning. During this period of time, the center bearing temperature can increase to as high as 1200 TM F. At such high temperatures, and because of the lack of oil flow, the small amount of oil remaining in the bearing carbonizes and ultimately the bearing will fail as a result of galling or seizure. The assembly of the invention eliminates this problem by supplying pressurized oil to the center bearing after the engine has been shut down.

The assembly of FIG. 5 may also be designed to provide adequate lubrication at the center bearing during engine start-up. Normally, the shaft in the center bearing of the turbocharger acts as a pump during the turbocharger spin-down period after the engine is shut down and, as a result, all the oil is drained from the oil line feeding the center bearing. During engine start-up, the oil line is thus empty and a lag is created during the time between generation of oil pressure by the engine and the time when the pressurized oil reaches the bearing. By dimensioning the cylinder 16 so that its capacity is greater than the volume of oil drained out of the oil line by the turbocharger during spin-down, the oil line will remain full after the turbocharger has stopped spinning and instantaneous oil pressure will be supplied to the center bearing at its subsequent start up.

Similar to the embodiment of the assembly illustrated in FIG. 4, the air valve 28 is used to purge the reservoir and its connecting lines of waste oil at each oil change.

It should be noted that the container illustrated in FIG. 5 may be fabricated in a manner similar to that shown in FIGS. 1–4. Similarly, the container previously described with reference to FIGS. 1 through 4 may be fabricated as an integral unit, instead of from separate elements, using "deep drawn" aluminum fabrication techniques, as illustrated in FIG. 5. Such an integral container is significantly less expensive to manufacture than a container fabricated from separate elements.

Figure 10:
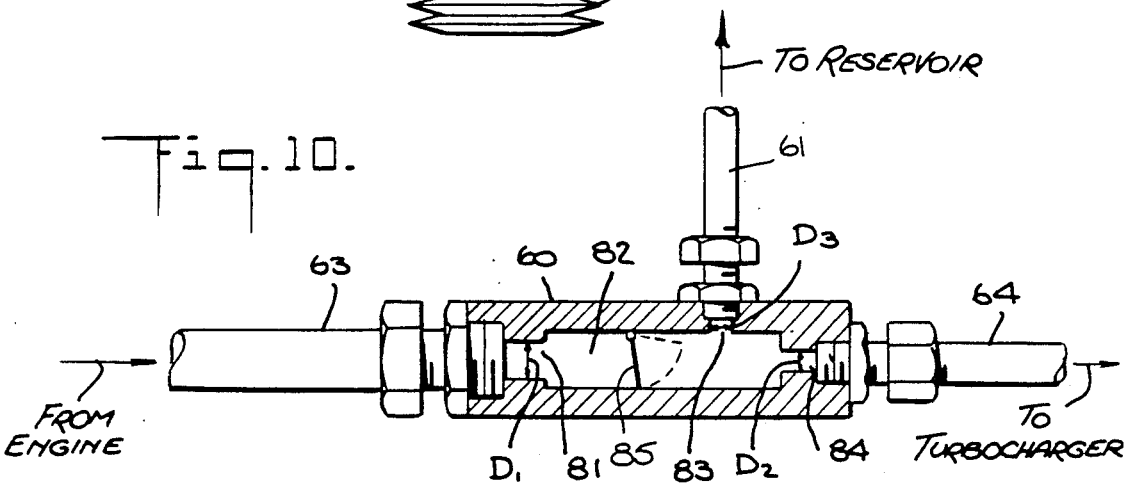
FIG. 10 is a schematic cross-sectional view of an advantageous embodiment of a T-type check valve in accordance with the present invention for use with the pressurized lubricant system for the center bearing of an exhaust driven turbocharger illustrated in FIG. 5.

FIG. 10 illustrates a preferred T-type check valve 60 and conduit arrangement for providing lubrication to the center bearing of an exhaust driven turbocharger.

T-type valve 60 in the illustrated embodiment is a check valve having an inlet orifice 81 connected to fluid conduit 63 which is in turn connected in fluid communication with the engine oil pump (not illustrated). For example, fluid conduit 63 may be connected to the engine oil gallery thereby providing fluid communication with the engine oil pump.

Inlet orifice 81 communicates with chamber 82 of T-type check valve 60. Hose or fluid conduit 61 is coupled in fluid communication with chamber 82 of T-type connection 60 via reservoir orifice 83 and with cylinder 16 of the lubricant reservoir 12. Fluid conduit 64 is coupled in fluid communication with chamber 82 of T-type connection 60 via outlet orifice 84 and fluid conduit 64 is also coupled to the center bearing of the turbocharger (not illustrated).

In the illustrated embodiment of FIG. 10, flapper or gate 85 is pivotally mounted within chamber 82 of T-type check valve 60 thus making the T-type connection a T-type check valve. It is to be understood that the T-type connection does not have to be a T-type check valve. Gate on flapper 85 may be omitted and a check valve may be position in hose or fluid conduit 63 which communicates with the engine lubrication system.

In the illustrated embodiment, the internal diameter of inlet orifice 81 is $D_1$. As illustrated, the internal diameter of fluid conduit 63 is also $D_1$.

The internal diameter of reservoir orifice 83 is $D_3$. In the illustrated embodiment, the internal diameter of fluid conduit 61 is also $D_3$.

The internal diameter of outlet orifice 84 is $D_2$. In the illustrated embodiment, the internal diameter of fluid conduit 64 is also $D_2$.

In the embodiment illustrated, the internal diameter of chamber 82 of T-type connection 60 is greater than $D_1$ but in practice may be equal to or greater than $D_1$ but never less than $D_1$.

In accordance with this embodiment of the present invention, the fluid flow cross-sectional area defined by $D_1$ is about twice or greater than twice the combined fluid flow cross-sectional area defined by $D_2$ and $D_3$.

Stated otherwise, in accordance with this embodiment of the present invention, the minimum fluid flow cross-sectional area of the first fluid conduit means 63 coupling chamber 82 of T-type connection 60 to the engine lubricant system is at least about twice the combined minimum fluid flow cross-sectional areas of the second fluid conduit means coupling chamber 82 to the lubricant reservoir 12 and the third fluid conduit means 64 coupling chamber 82 to the turbocharger center bearing.

In accordance with the present invention this assures that when the engine is running (and thereby pressurized lubricant is being supplied by the engine lubricant pump to the turbocharger), the volume of lubricant available to chamber 82 is at least as great as the combined lubricant flow rates in the fluid conduit means 61 coupling chamber 82 to the lubricant reservoir 12 and the fluid conduit means 64 coupling chamber 82 to the center bearing of the turbocharger.

The T-connection of the embodiment of the invention illustrated in FIG. 10 assures proper lubricant flow to the reservoir and to the turbocharger center bearing at all times. Construction of the invention assures that when a discharged reservoir is being refilled, this refilling will not have an adverse effect on the volume of lubricant flowing through check valve 60 via orifice 84 and lubricant hose 64 to the turbocharger during cold start ups. The construction of the invention also insures that there is a rapid refill of the reservoir 12 after discharge which is especially advantageous in situations of numerous starts and stops, moderate speed and then idle or crankcase surge.

Tests have shown that the following dimensions are suitable for the construction illustrated in FIG. 10: internal diameter of inlet orifice 81, feed or supply conduit 63, and chamber 82—$\frac{1}{2}$ to $\frac{5}{8}$ inch; internal diameter of outlet orifice 84 and conduit 64—5/16 to $\frac{3}{8}$ inch; reservoir orifice 83 and reservoir conduit 61—$\frac{1}{4}$ inch. It should be understood that these dimensions are merely given by way of example.

It will also become apparent that the T-connection of the present invention used in conjunction with a pressurized lubricant system for the center bearing of a turbocharger is not limited to use with a hollow pressurized lubricant reservoir. Other types of lubricant reservoirs may be used. For example, the piston type pressurized lubricant reservoir disclosed in my U.S. Pat. No. 4,094,293 may be used.

The pressurized lubricant system for the center bearing of an exhaust driven turbocharger illustrated in FIG. 5 may also usefully employ valve assembly 14 as illustrated in FIG. 6.

Referring to FIGS. 5 and 6, valve assembly means 14 is disposed in fluid conduit means 61 (not illustrated) between the reservoir 12 and T-type check valve 60. Valve assembly means 14 would function at engine start up and shut down as hereinbefore described in conjunction with FIGS. 1 to 4.

In this embodiment of the present invention, the spring in spring-loaded relief valve 71 would be set so that ball 72 will raise off its seat at a pressure which is intermediate the lubricant pressure flowing to the center bearing when the engine lubricant system is operating normally and zero pressure, i.e., the pressure supplied to the center bearing by the engine lubricant system when the engine is shut down. For example, if the pressure of lubricant flowing to the center bearing is normally, e.g., about 35 p.s.i.g. to 60 p.s.i.g. reflecting normal operation of the engine lubricant system, the spring of spring-loaded relief valve 71 may be set for ball 72 to raise off its seat at 20 p.s.i.g Operation of this embodiment of the present invention is as follows. Assume that the engine is operating normally and reservoir 12 has lubricant stored therein at 60 p.s.i.g. The engine lubricant system is supplying lubricant to the center bearing of the turbocharger via fluid conduits 63 and 64. During normal operation, solenoid 46 of valve assembly 14 will be de-energized and plunger 47 will be seated against diaphragm 42 as hereinbefore described. The lubricant pressure in chamber 40 of valve assembly 14 provided by the engine lubricant system prevents discharge of the reservoir lubricant via valve 71.

At engine shut down, the engine lubricant pump will stop and the engine thus stops providing lubricant to the turbocharger center bearing. Thus, the pressure of lubricant flowing to the center bearing starts to fall towards zero. Solenoid 46 of valve assembly 14 remains de-energized. With the lubricant pressure from the engine lubricant system decreasing, spring-loaded relief valve 71 will open and pressurized lubricant will flow from the reservoir 12, through relief valve 71, into chamber 40, and through outlet pipe 37 which is connected to fluid conduit 61, thence to check valve 60 and on to the center bearing. Thus, the lubricant reservoir 12 is providing pressurized lubricant to the center bearing even though valve 14 is closed (i.e. deenergized).

When the pressurized lubricant stored in the reservoir 12 reaches the example pressure of 20 p.s.i.g. (or an other selected pressure setting for relief valve 71), flow of lubricant from the reservoir 12 will stop and lubricant will remain stored in the reservoir 12 at the rate pressure of the relief valve.

When the engine is subsequently started, solenoid 46 will be energized as hereinbefore described. Plunger 47 will lift off diaphragm 42 and the pressurized lubricant stored in reservoir 12 will lift diaphragm 42 off partition 38 and a flow of pressurized lubricant remaining at the relief valve setting will be provided to the center bearing at initial engine start up.

As engine lubricant pressure builds up, solenoid 46 may become de-energized or remain open (energized) until engine shut down as discussed in the foregoing. After pressure builds up in the engine lubricant system, reservoir 12 will be again charged with lubricant via fluid conduit 61 and valve assembly 14 with valve assembly 14 operating as hereinbefore described.

Reservoir means 12 may be appropriately sized and relief valve 71 properly sized so that sufficient lubricant will be provided to the center bearing both at engine shut down and at initial engine start up.

It will be appreciated that the embodiment of the valve means of FIG. 6 use in a pressurized lubricant system for the center bearing of a turbocharger may be used in combination with a large variety of pressurized lubricant reservoirs. For example, the piston type pressurized lubricant reservoir disclose in my U.S. Pat. No. 4,094,293 may be used.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An improved prelubricator and pressurized lubrication reservoir assembly for lubricating machinery, such as an internal combustion engine, when the lubricant pressure in the machinery is below a specified level, said assembly comprising:

reservoir means comprising a container having an external wall for storing a quantity of lubricant under pressure;

conduit means for coupling said reservoir means and said machinery in fluid communication whereby lubricant flows in said conduit means in a first direction from said machinery to said reservoir means and in a second direction from said reservoir means to said machinery;

valve means disposed in said conduit means for selectively permitting flow of lubricant in said conduit means in said second direction when the lubricant pressure in said machinery is below said specified level and preventing flow of lubricant in said conduit means in said second direction when the lubricant pressure in said machinery is above said specified level; and pressure relief valve means disposed within said valve means and in fluid communication with and responsive to the pressure of said lubricant stored in said reservoir means for selectively permitting flow of lubricant through said valve means and thereby through said conduit means in said second direction when the pressure of the lubricant stored in said reservoir means approaches the rupture strength of said container external wall.

2. An improved prelubricator and pressurized lubrication reservoir assembly for lubricating machinery, such as an internal combustion engine, when the lubricant pressure in the machinery is blow a specified level, said assembly comprising:

reservoir means comprising a container having an external wall for storing a quantity of lubricant under pressure;

conduit means for coupling said reservoir means and said machinery in fluid communication whereby lubricant flows in said conduit means in a first direction from said machinery to said reservoir means and in a second direction from said reservoir means to said machinery;

valve means disposed in said conduit means for selectively permitting flow of lubricant in said conduit means in said second direction when the lubricant pressure in said machinery in below said specified level and preventing flow of lubricant in said conduit means in said second direction when the lubricant pressure in said machinery is above said specified level; and pressure relief means for selectively actuating said valve means responsive to the pressure of said lubricant stored in said reservoir means when the pressure of the lubricant stored in said reservoir means approaches the rupture strength of said container external wall thereby selectively permitting lubricant flow through said valve means and said conduit mans in said second direction.

3. An improved prelubricator and pressurized lubrication reservoir assembly for lubricating machinery, such as an internal combustion engine, when the lubricant pressure in the machinery is below a specified level, said assembly comprising:

reservoir means comprising a container having an external wall defining a lubricant storage area for storing a quantity of lubricant under pressure;

conduit means for coupling said reservoir means and said machinery in fluid communication whereby lubricant flows in said conduit means in a first direction from said machinery to said reservoir means and in a second direction from said reservoir means to said machinery;

valve means disposed in said conduit means for selectively permitting and preventing flow of lubricant in said conduit means;

wherein said storage area is closed to fluid communication with atmosphere during machinery shut down when said valve means prevents flow of lubricant in said conduit means and said lubricant is stored in said lubricant storage area under pressure; and pressure relief means in fluid communication with said lubricant stored in said reservoir means set to discharge lubricant from said reservoir means when the pressure of the lubricant stored in said reservoir means approaches the rupture strength of said container external wall.

4. An assembly as recited in claim 3 wherein said pressure relief means comprises a relief valve means coupled in direct fluid communication with said reservoir means.

* * * * *